US009470074B2

(12) United States Patent
Bolding et al.

(10) Patent No.: US 9,470,074 B2
(45) Date of Patent: Oct. 18, 2016

(54) DEVICE AND METHOD FOR IMPROVING GAS LIFT

(71) Applicant: DROVER ENERGY SERVICES LLC, Kilgore, TX (US)

(72) Inventors: Jeffrey L. Bolding, Kilgore, TX (US); Joseph D. Clark, Kilgore, TX (US)

(73) Assignee: Drover Energy Services LLC, Kilgore, TX (US)

( * ) Notice: Subject to any disclaimer, the term of this patent is extended or adjusted under 35 U.S.C. 154(b) by 156 days.

(21) Appl. No.: 14/298,431

(22) Filed: Jun. 6, 2014

(65) Prior Publication Data

US 2015/0354325 A1 Dec. 10, 2015

Related U.S. Application Data

(60) Provisional application No. 61/832,420, filed on Jun. 7, 2013.

(51) Int. Cl.
*E21B 43/12* (2006.01)
*E21B 23/03* (2006.01)

(52) U.S. Cl.
CPC ..... *E21B 43/122* (2013.01); *E21B 23/03* (2013.01)

(58) Field of Classification Search
CPC ..... E21B 43/12; E21B 43/122; E21B 43/16; E21B 33/12; E21B 34/06; E21B 23/03
See application file for complete search history.

(56) References Cited

U.S. PATENT DOCUMENTS

| | | | | |
|---|---|---|---|---|
| 3,025,912 | A * | 3/1962 | Schramm | E21B 33/076 166/124 |
| 4,708,595 | A | 11/1987 | Maloney | |
| 6,951,252 | B2 * | 10/2005 | Restarick | E21B 23/03 166/117.6 |
| 7,770,637 | B2 | 8/2010 | Phoi-Montri | |
| 2009/0255684 | A1 * | 10/2009 | Bolding | E21B 43/122 166/372 |
| 2015/0233228 | A1 * | 8/2015 | Roth | E21B 43/128 166/372 |

OTHER PUBLICATIONS

International Search Report, PCT/US14/41387, Oct. 24, 2014.

* cited by examiner

*Primary Examiner* — Yong-Suk (Philip) Ro
(74) *Attorney, Agent, or Firm* — The Kubiak Law Firm, PLLC

(57) ABSTRACT

A device and method to lower the deepest gas lift location to a deeper location within the wellbore. Providing a bottom lift tool with flexible joints to sting into a side pocket mandrel to access annular high pressure gas. Diverting that gas into the stinger through the bottom lift tool down into the wellbore below the lowest end of the production tubular and the packer and preferably to at least the bottom of the perforations in the casing.

20 Claims, 8 Drawing Sheets

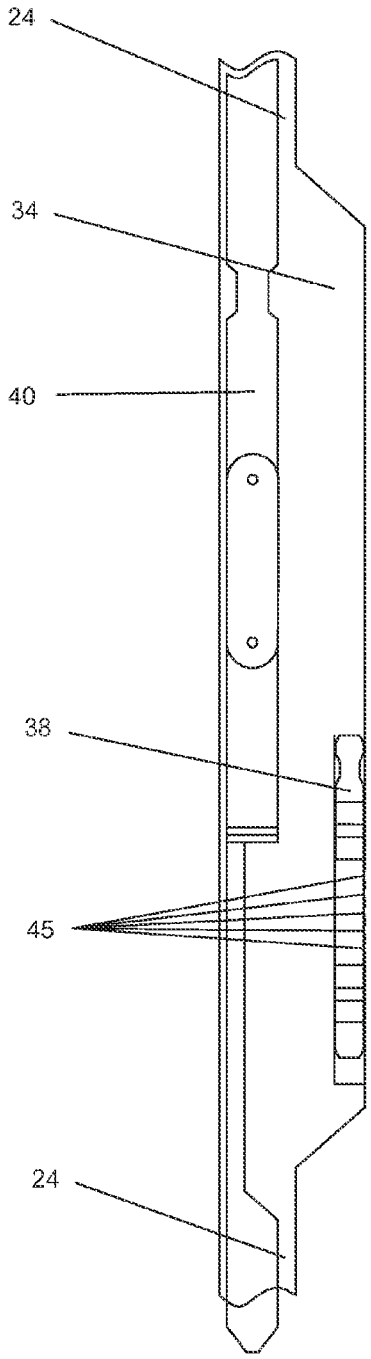
Fiugre 6
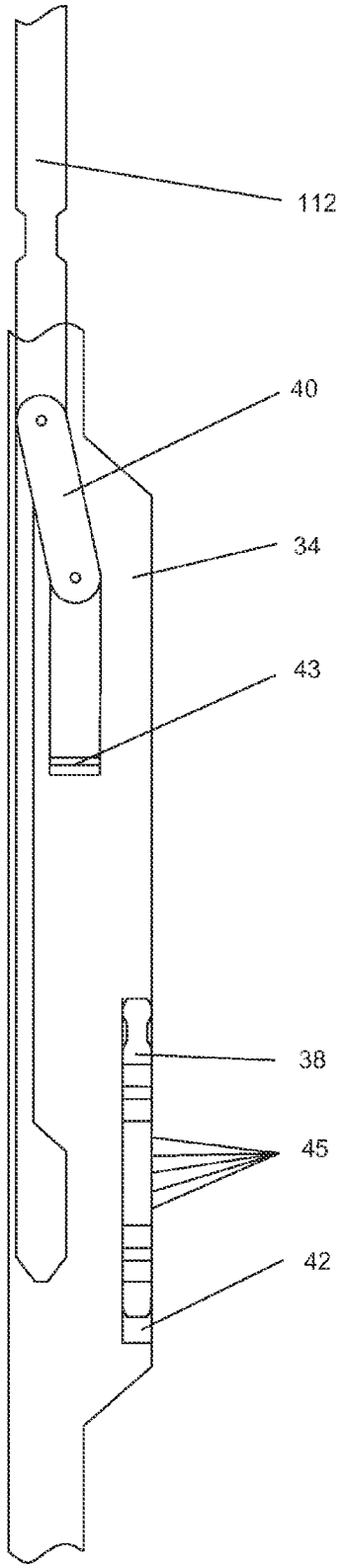
Figure 7

DEVICE AND METHOD FOR IMPROVING GAS LIFT

CROSS-REFERENCE TO RELATED APPLICATIONS

This application claims priority to U.S. Provisional Patent Application No. 61/832,420 that was filed on Jun. 7, 2013.

FIELD OF INVENTION

Embodiments of the present invention generally relate to methods and apparatuses for a downhole operation. More particularly, the invention relates to methods and apparatuses for providing gas lift where gas is provided via an annular region accessed by a side pocket mandrel.

BACKGROUND

Many hydrocarbon producing wells around the world, require artificial lift. A common form of artificial lift is gas lift. The purpose of a gas lift system is to introduce gas below the fluid column in order to increase the velocity of the fluid, thereby lifting the fluid to the surface. Gas lift systems typically have several gas injection points along the length of the fluid column in the wellbore.

Typically the production tubing is run inside the cased well preferably terminating just above the perforations in the casing. At the lower end of the production tubing a packer is utilized to seal the lower end of production tubing to the casing. The gas injection points typically consist of side pocket mandrel's with gas lift valves in each side pocket.

With the gas lift system in operation, pressurized gas is supplied to the annular region formed between the exterior of the production tubing and the interior of the casing. The packer at the lower end of the production tubing prevents the pressurized gas from flowing into the formation. Typically the only pathway for the pressurized gas to flow is through the gas lift valves in the side pocket mandrels. As the pressurized gas enters the fluid column through the gas lift valves, the fluid column is lightened by mixing gas with the fluid, increasing the velocity of the fluid as it moves upward in the production tubing thereby lifting fluid out of the well.

Because the pressurized gas is supplied through the annular area between the production tubing and the casing, the pressurized gas supply is typically limited to the area above the packer. Commonly the packer may be set 100 feet above the perforations through the casing. However in some instances, the distance from the packer to the bottom perforations can be quite large, in some cases as much as 1000 feet or more. As the well is depleted, the natural fluid level of the well may be lower than the lowest injection point in the gas lift system thereby rendering the gas lift system virtually useless and thereby rendering the fluid remaining in the well below the packer essentially unrecoverable by current gas lift methods.

The current invention describes an apparatus and method to lower the initial gas lift location to a deeper location within the wellbore that in many instances is below the packer and below the bottom of the production tubular.

BRIEF DESCRIPTION OF THE DRAWINGS

FIG. 6 depicts the first stage of retrieving a gas lift valve with the kick over tool.

FIG. 7 depicts the second stage of retrieving a gas lift valve with the kick over tool.

DETAILED DESCRIPTION OF THE INVENTION

Figure 1:
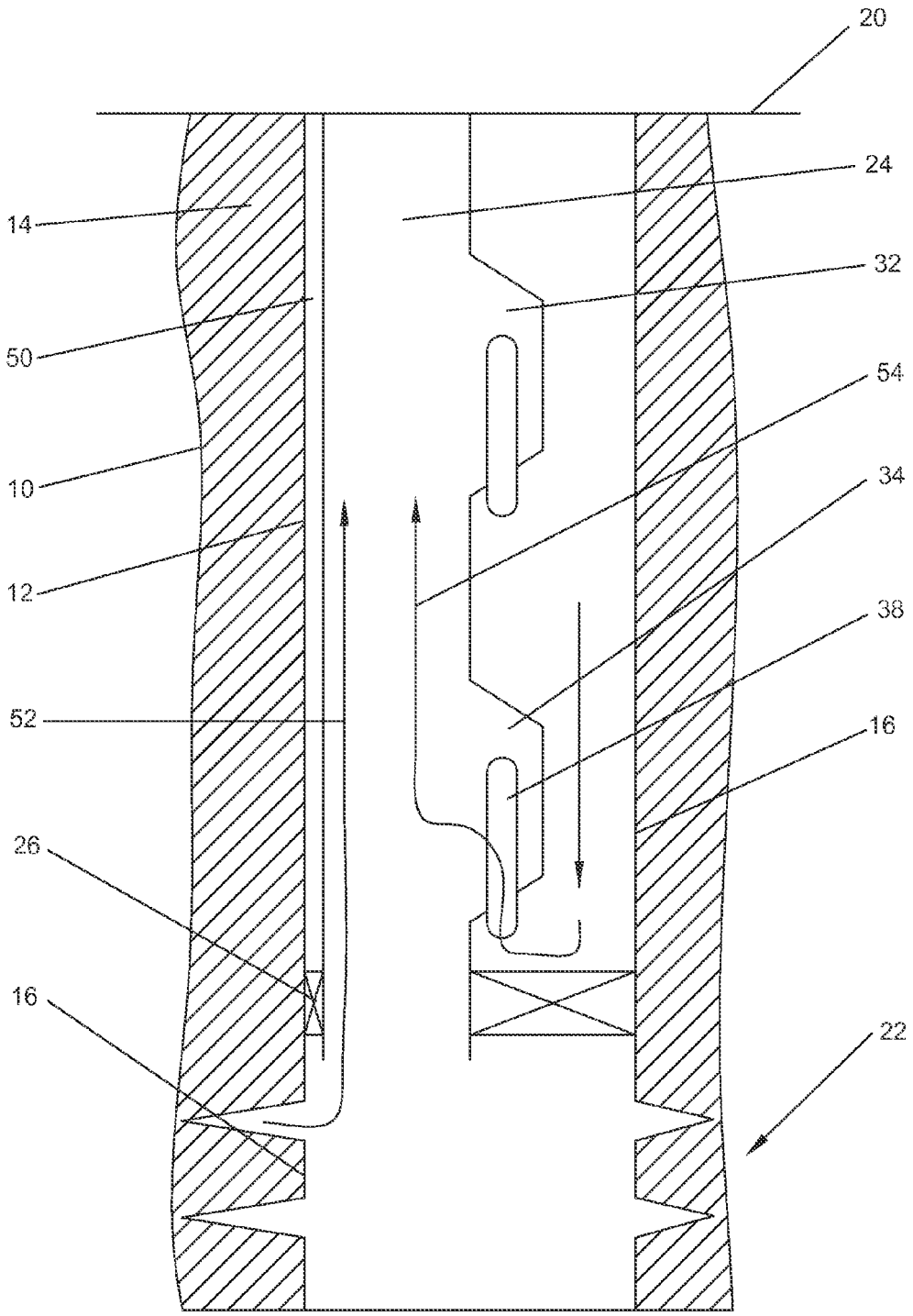
FIG. 1 depicts a typical gas lift system.

FIG. 1 depicts a typical gas lift system. A wellbore 10 has a casing 12 that is run from the surface 20 through the formation zone 22. Cement 14 holds the casing 12 in place and prevents the migration of wellbore fluids upwards between the casing 12 and the wellbore 10. The casing 12 has perforations 16 to allow access from the formation zone 22 to the interior of the casing 12. A production tubular 24 is run into the casing 12 from the surface 20. A packer 26 is run in into the casing 12 on the production tubular 24 near or at the lower end of the production tubular 24. The production tubular 24 has at least one side pocket mandrels. In FIG. 1, two side pocket mandrels 32, and 34 are shown.

Figure 2:
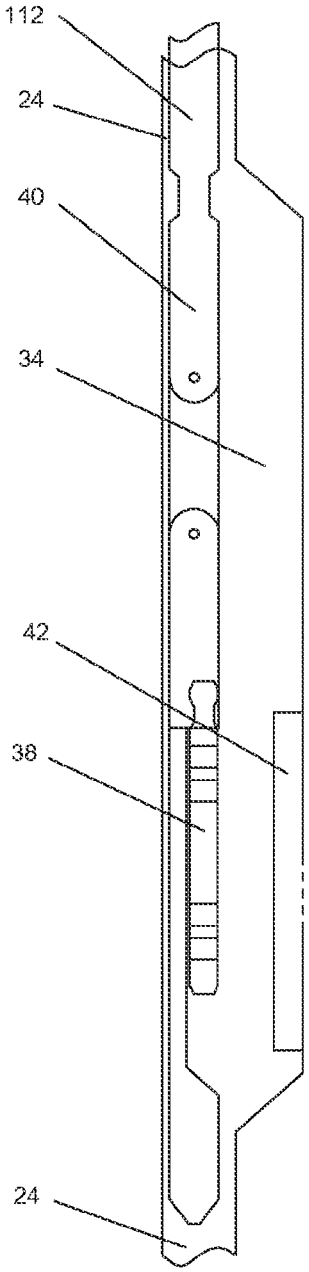
FIG. 2 depicts the initial stage of the installation of a gas lift valve.

FIG. 2 depicts the initial stage of the installation of a gas lift valve 38 in the side pocket mandrel 34. As the kick over tool 40 is run into the production tubular 24 on e-line, slick line, coil tubing, or any other means known in the industry, it is run slightly past the side pocket mandrel 34 in order to facilitate the location of the side pocket mandrel 34.

Figure 3:
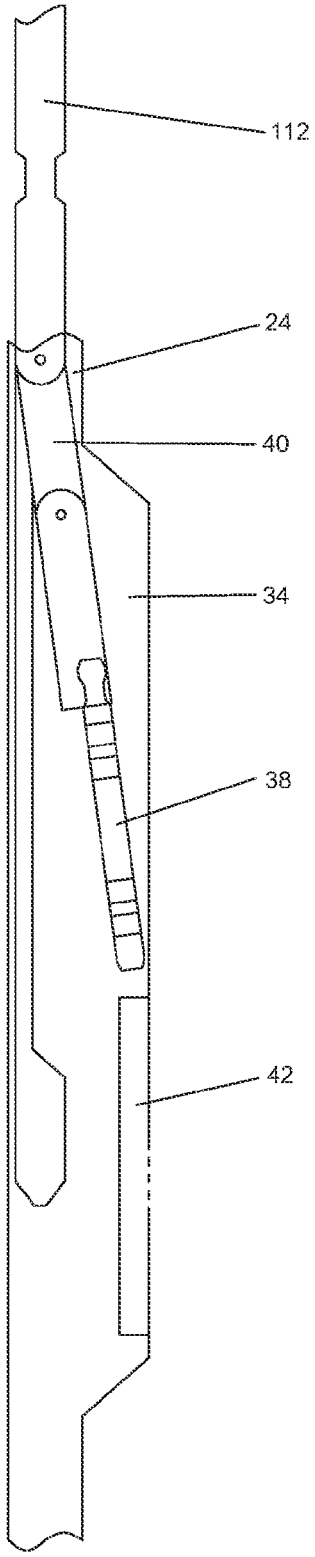
FIG. 3 depicts the second stage of the installation of the gas lift valve

FIG. 3 depicts the second stage of the installation of the gas lift valve 38 in the side pocket mandrel 34. The kick over tool 40 has been longitudinally located at the side pocket mandrel 34 and has been rotated to orient the gas lift valve 38 into the side pocket 42. The kick over tool 40 then kicks out the gas lift valve 38.

Figure 4:
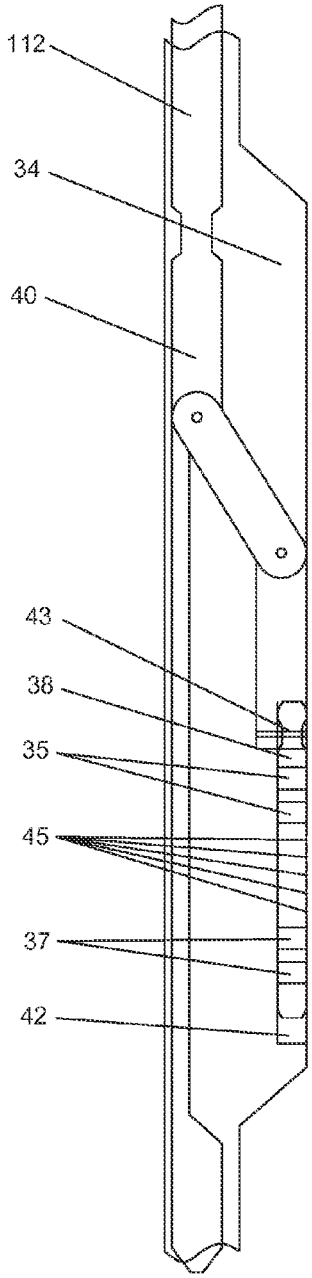
FIG. 4 depicts the third stage of the installation of the gas lift valve.

FIG. 4 depicts the third stage of the installation of the gas lift valve 38 in the side pocket mandrel 34. With the gas lift valve 38 kicked out into the side pocket mandrel 34 the kick over tool 40 is jarred down so that the gas lift valve 38 is set into the side pocket 42 so that seals 35 and 37 on the gas lift valve straddle the inlets 45. Seals 35 and 37 allow pressurized gas to flow in from the annular area and into the gas lift valve 38. The pressurized gas then typically flows upward through the gas lift valve where the pressurized gas may be regulated before being injected into the fluid stream adjacent the side pocket mandrel 34. Additionally, a release device 43 such as a shear pin, sheer screw, C ring, or other release device is actuated to release the kick over tool 40 from the gas lift valve 38.

Figure 5:
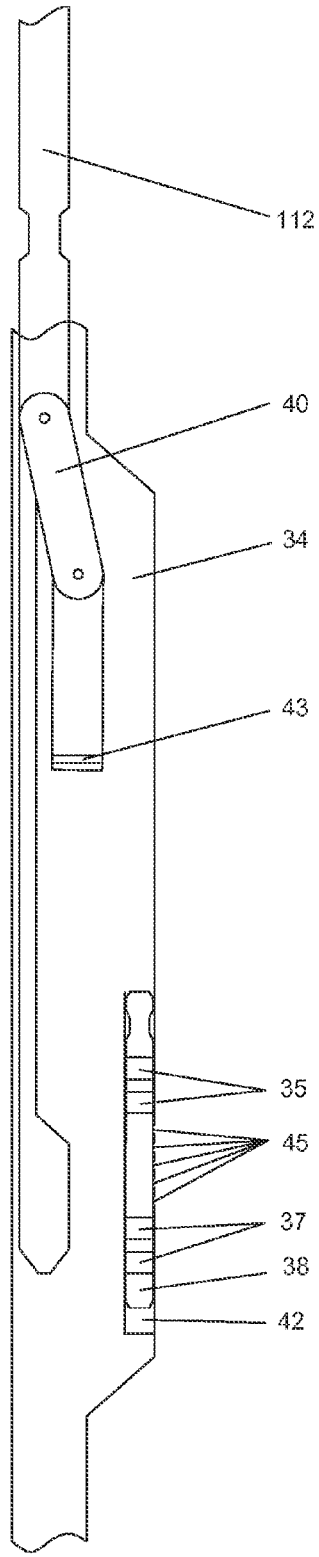
FIG. 5 depicts the fourth stage of the installation of the gas lift valve.

FIG. 5 depicts the fourth stage of the installation of the gas lift valve 38 in the side pocket mandrel 34. With the gas lift valve 38 installed in the side pocket 42 and the kick over tool 40 released from the gas lift valve 38 the kick over tool 40 is then retrieved to the surface 20.

Referring back to FIG. 1 with the gas lift valve 38 installed in the side pocket 34 the operator may begin to utilize the gas lift system by pressurizing the annular area 50 formed between the production tubular 24 and the casing 12. The packer 26 below the lowest side pocket mandrel 34 prevents the pressurized gas in the annular area 50 from flowing into the formation zone 22. As fluid from the formation zone 22 flows through perforations 16 and into the casing 12 it moves into the production tubing 24 upwards past the lowest side pocket mandrel 34. Fluid flow is depicted by arrow 52. The pressurized gas in the annular area 50 flows in to the side pocket via inlets 45 then into and through the gas lift valve 38 in side pocket mandrel 34 to mix with the fluid from the formation zone 22 to both reduce the density of the fluid thereby lightening the column of liquid that must move upwards to the surface 20 and increases the fluids velocity. The pressurized gas flow through gas lift valve 38 is depicted by arrow 54.

At some point in the life of the gas lift system it may be necessary to change the gas lift valve 38 so that a new gas lift valve may be installed in the side pocket mandrel. New gas lift valves may be required for instance due to corrosion, valve failure, larger flow ports are necessary, smaller flow ports are necessary, or to install an embodiment of the invention as further described below.

FIG. 6 depicts the first stage of retrieving a gas lift valve 38 with the kick over tool 40. As the kick over tool 40 is run into the production tubular 24 it is run slightly past the side pocket mandrel 34 in order to facilitate the location of the gas lift valve 38 in the side pocket mandrel 34.

FIG. 7 depicts the second stage of retrieving a gas lift valve 38 with the kick over tool 40. The kick over tool 40 has been longitudinally located at the gas lift valve 38 and has been rotated to orient the release device 43 into the side pocket 42 and towards the top of the gas lift valve 38.

Figure 8:
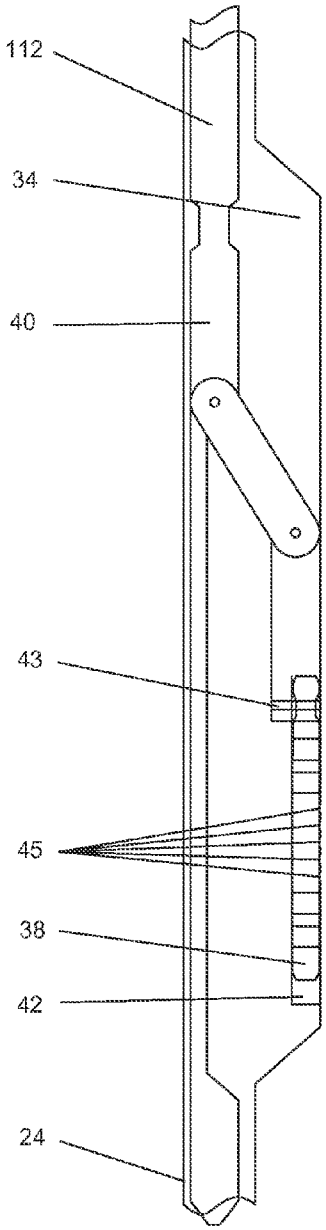
FIG. 8 depicts the third stage of retrieving a gas lift valve with the kick over tool.

FIG. 8 depicts the third stage of retrieving a gas lift valve 38 with the kick over tool 40. With the release device 43 kicked out into the side pocket mandrel 34 and towards the top of the gas lift valve 38 the kick over tool 40 and thus the release device 43 are jarred down so that the release device 43 latches onto the top of the gas lift valve 38. Subsequent jarring unsets the gas lift valve 38.

Figure 9:
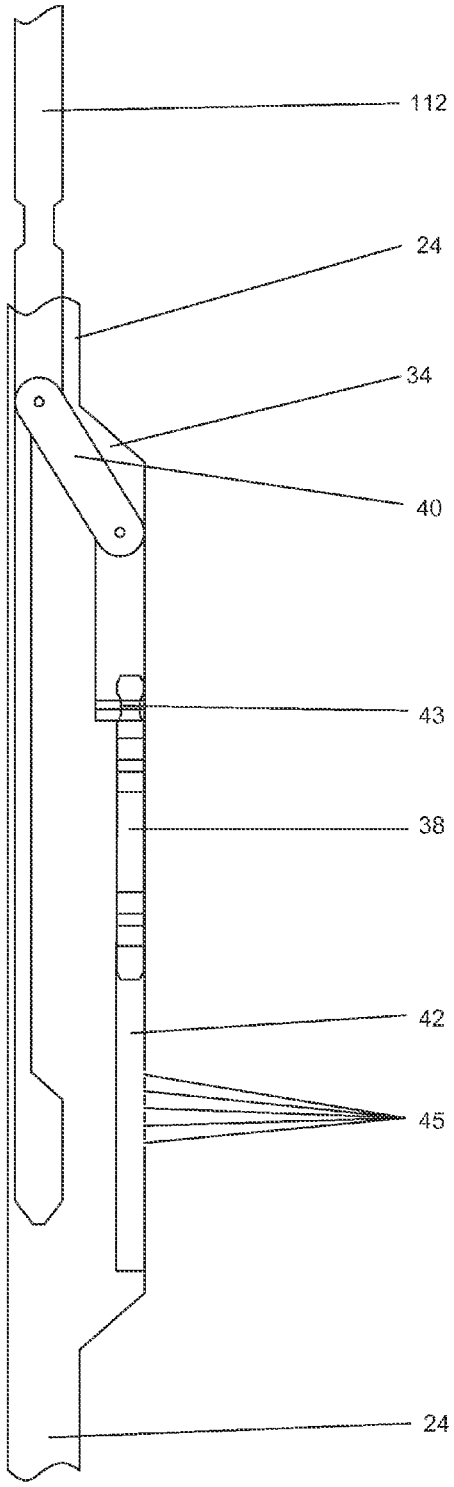
FIG. 9 depicts the fourth stage of retrieving a gas lift valve with the kick over tool.

FIG. 9 depicts the fourth stage of retrieving the gas lift valve 38 from the side pocket mandrel 34 with the kick over tool 40. With the gas lift valve 38 latched into the retrieving device 43 and unset from the side pocket mandrel 34 the kick over tool 40 and the gas lift valve 38 may be retrieved to the surface 20.

Figure 10:
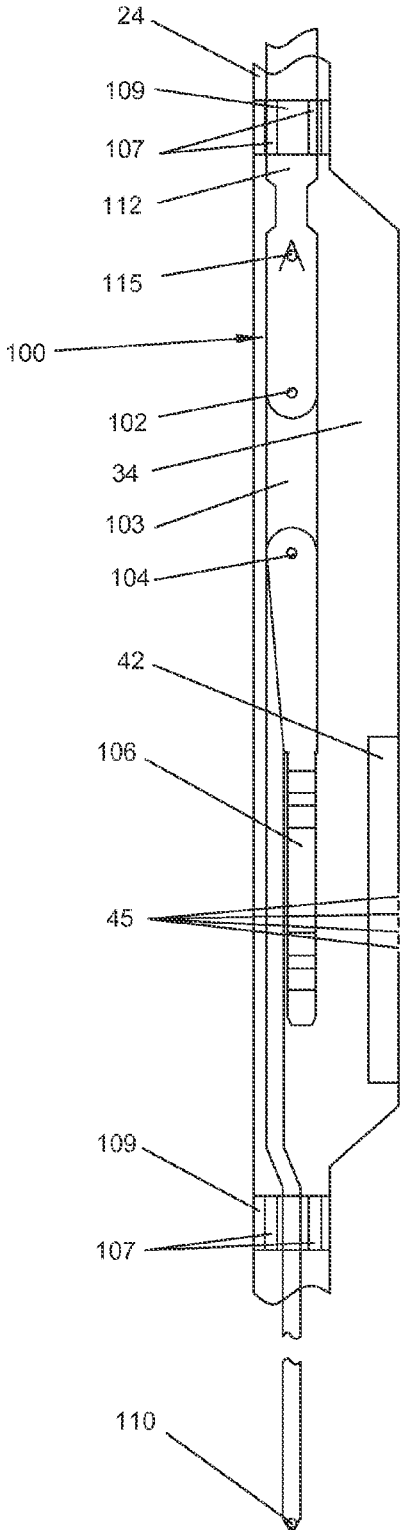
FIG. 10 depicts an embodiment of the current invention where the kick over tool has been replaced by a bottom lift tool.

FIG. 10 depicts an embodiment of the current invention where the kick over tool has been replaced by a bottom lift tool 100. The bottom lift tool 100 has a stinger 106 at the upper end of the stinger 106 is a high pressure swivel 104 at the upper end of the high pressure link 103 is a second high pressure swivel 102 which in turn is connected to bottom lift injector 110. Bottom lift injector 110 typically extends some distance, possibly hundreds of feet, below the inlets 45 and more preferably extend below the formation zone (not shown). The stinger 106 may simply be a connection to sting into the gas lift mandrel 34 or it may be a gas lift valve to control the flow from the annulus into the bottom lift tool 100. In certain instances either high pressure swivel 102 or 104 could be replaced with a high pressure hose or other flexible conduit. In certain instances the entire assembly high pressure swivel 102 high pressure link 103 and high pressure swivel 104 could all be replaced with a high pressure hose or other flexible conduit. Typically the bottom lift injector 110 is attached to or is a part of coil tubing between three quarters of an inch and 1 inch outer diameter although larger or smaller diameters may be used.

The bottom lift tool 100 has a body 108. In many instances the body 108 has a check valve 115 to relieve pressure from the inner bore of the bottom lift tool 100, see FIG. 12 Typically the bottom lift tool 100 has a standard size. In order to allow a standard size bottom lift tool 100 to be run into any larger size tubular interchangeable centralizer rings 109 may be provided. Typically the centralizer rings 109 are roller bogey centralizer rings and have vertical grooves or ports 107 to allow fluid to flow past the centralizer rings 109 as the bottom lift tool is run into the hole as well as when fluid is produced out of the well past the bottom lift tool.

FIG. 10 depicts the bottom lift tool 100 in the first stage of its installation in the side pocket mandrel 34. As the bottom lift tool 100 is run into the production tubular 24 on a work line 112 such as e-line, slick line, coil tubing, or any other means known in the industry, it is run slightly past the side pocket mandrel 34 in order to locate the stinger 106 to the side pocket mandrel 34.

Figure 11:
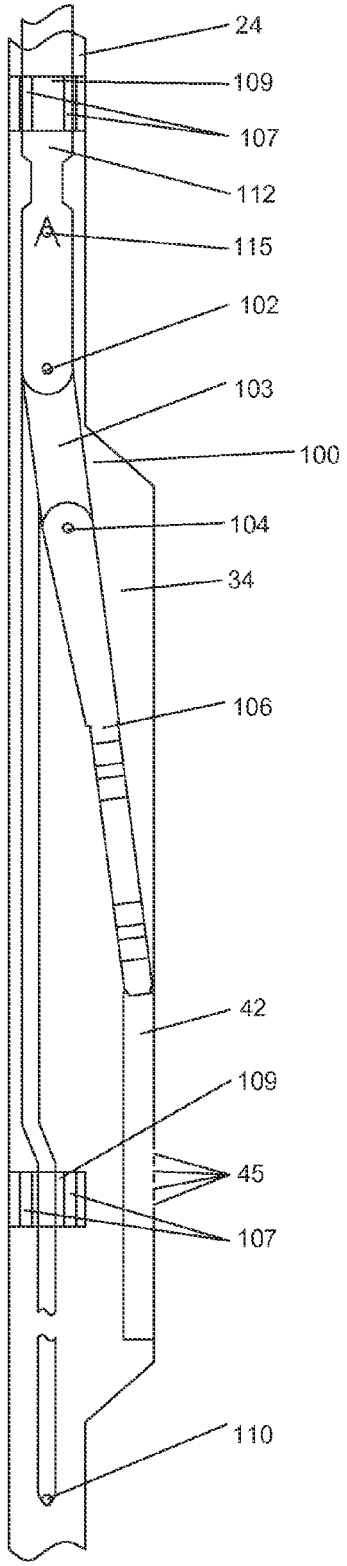
FIG. 11 depicts the bottom lift tool in the second stage of its installation in the side pocket mandrel.

FIG. 11 depicts the bottom lift tool 100 in the second stage of its installation in the side pocket mandrel 34. The stinger 106 has been longitudinally located to the side pocket mandrel 34 and has been rotated to orient the stinger 106 into the side pocket 42. The bottom lift tool 100 then kicks out the stinger 106.

Figure 12:
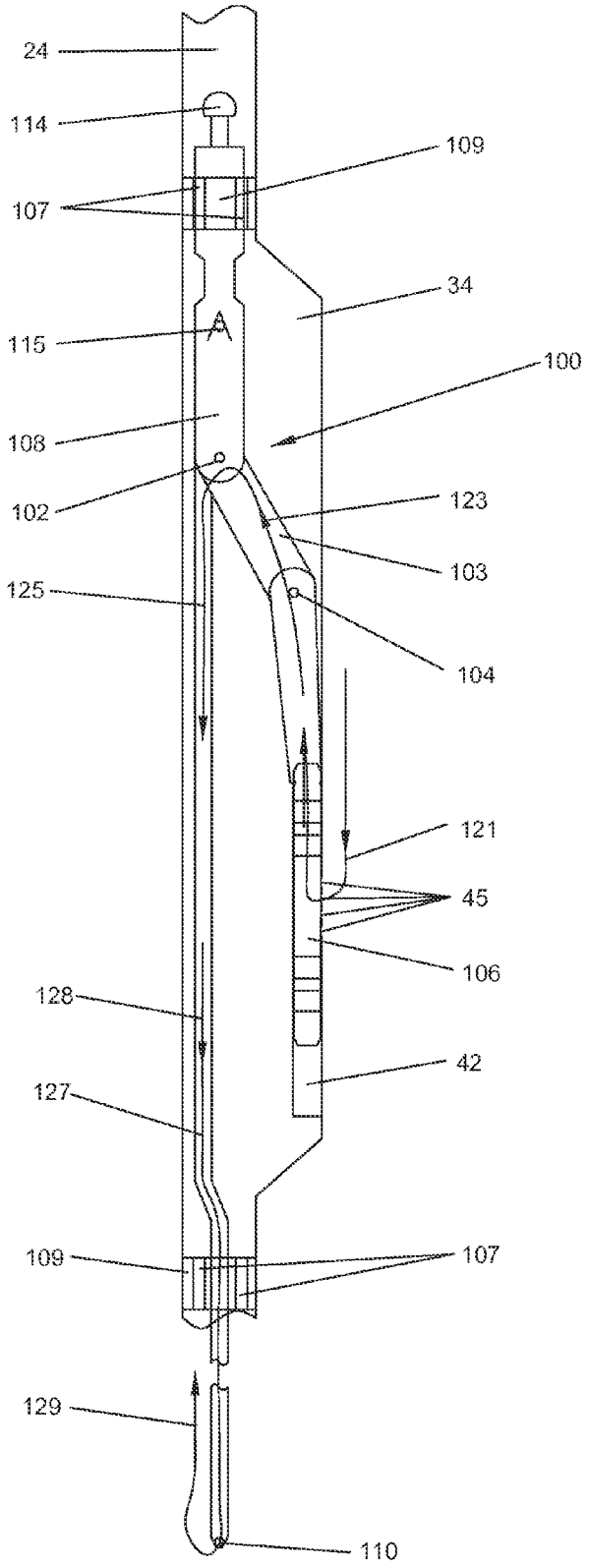
FIG. 12 depicts the bottom lift tool in the final stage of its installation in the side pocket mandrel.

FIG. 12 depicts the bottom lift tool 100 in the third stage of its installation in the side pocket mandrel 34. With the stinger 106 kicked out into the side pocket mandrel 34 the bottom lift tool 100 is jarred down so that the stinger 106 is set into the side pocket 42. A release device 114 such as a fishing neck, shear pin, sheer screw, C ring, or other release device is typically located at the upper end of the bottom lift tool 100 and where the bottom lift tool 100 is sized so that the release device 114 will be below the upper end of the side pocket mandrel 34 thereby providing a less restricted pathway for fluid to flow past the bottom lift tool 100 when the work line 112 is pulled out of the hole. The release device 114 may be actuated to release the bottom lift tool 100 from the work line 112. The work line 112 is then removed from the tubular 24 leaving the bottom lift tool 100 in place with the stinger 106 engaged with the side pocket 42 in side pocket mandrel 34. Thereby allowing the downward end of bottom lift injector 110 to descend to the depth desired by the operator. Typically such depth is lower than the lowest side pocket mandrel 34, lower than packer 26, and in many instances lower than perforations 16 in the casing 12.

High pressure gas flow from the annular region flows through inlet 45 and into stinger 106 as depicted by arrow 121 the high pressure gas flow then continues upwards in the stinger 106 through high pressure swivel 104 and into high pressure link 103 as depicted by arrow 123. The high pressure gas then continues on upward through high pressure swivel 102 and into the coil tubing of 128 bottom lift tool 100 where it is directed back downwards through the coil tubing 128 as depicted by arrow 125 the high pressure gas then continues downward through the bottom lift injector 110 as depicted by arrow 127 until it is injected into the fluid column as depicted by arrow 129.

In certain instances, such as when a stinger replaces the gas lift valve 106 in the bottom lift tool 100, a gas lift valve, nozzle, or other flow restriction may be placed at any location in the bottom lift tool 100 such as in the bottom lift injector 110 or in the body 108 of the bottom lift tool 100.

In other instances the stinger 106 may incorporate a gas lift valve, nozzle, or other flow restriction while also allowing gas to flow into the bottom lift tool 100 then down through the coil tubing 128 to the bottom lift injector 110. By utilizing a gas lift valve in the stinger 106 as well as a gas lift valve or other nozzle in bottom lift injector 110 at least two separate gas lift locations may be utilized. Additionally, the coil tubing 128 may incorporate gas lift valves, nozzles, or other flow restrictions along its length thereby allowing numerous gas lift injection sites along the length of the coil tubing 128 before the high pressure gas reaches the bottom lift injector 110. Multiple gas lift injection sites along the length of the bottom lift injector 110 are particularly useful when the bottom of the production tubular 24 or the packer 26, as indicated in FIG. 13, are far from the producing formation 17, as indicated in FIG. 13, for example 1000 feet.

Figure 13:
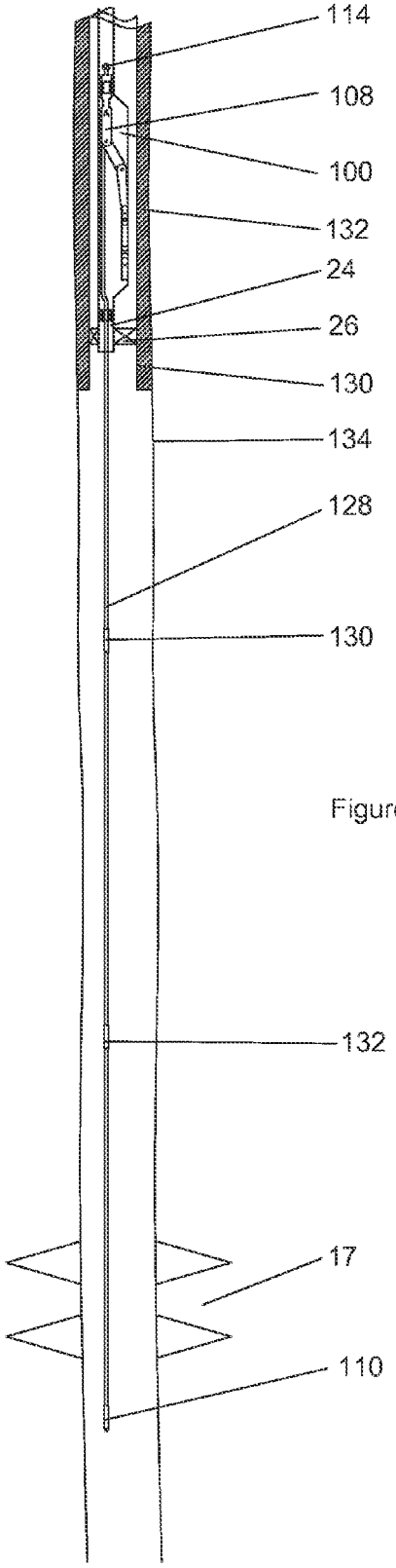
FIG. 13 depicts an extended length bottom lift tool having multiple gas lift valves along its length.

FIG. 13 depicts a bottom lift tool 100, such as the bottom lift tool 100 depicted in FIG. 12, having an extended length coil tubing 128 with a bottom lift injector 110, which may incorporate a gas lift valve or other nozzle to regulate the gas flow through the nozzle and further includes a first gas lift valve 130 and a second gas lift valve 132 along the length of the bottom lift injector 110. The bottom lift tool 100 is depicted in casing 131 that is cemented by cement 132 in the well 134. As depicted the casing 130 does not extend to the formation zone 17 in practice the casing 130 may or may not extend to the formation zone 17 and may or may not be cemented to formation zone 17. Depending upon the operation any number of gas lift valves may be used along the length of the coil tubing 128. Additionally the lower end of the bottom lift injector 110 may incorporate an additional gas lift valve, a nozzle, or may remain open so that gas may exit the lower end of the bottom lift injector 110. The operator may desire multiple gas lift injection sites along the length of the coil tubing 128 as it connects to the bottom lift injector 110 in those instances when the coil tubing 128 connecting the body 108 of the bottom lift tool 100 to the bottom lift injector 110 is extremely long and having a single gas lift valve or nozzle at only the lower end of the bottom lift injector 110 would be insufficient or impractical.

In another embodiment the release device 114 may be a fishing neck. The release device 114 may be an overshot or 108 have an internal or external polished bore receptacle, thereby allowing coil tubing to fluidically engage and inject gas or fluids such as chemicals to unload the well or treat the well for other production problems. Additionally, the release device 114 in addition to having an internal or external polished bore receptacle or in some instances in place of having a polished bore receptacle may provide an electrical power or data connection. By providing an electrical power or data connection a downhole data device to record and transmit data such as temperature, pressure, and valve state may be communicated to the surface. The electrical power or data connection could be a wet connect or by induction.

In practice a typical gas lift system reaches its production limits when the fluid level from the well is reduced to a level below the lowest gas injection point. Because gas lift wells typically use the annular region between the casing in the production tubular to provide high pressure gas and the bottom of this annular area must be packed off the bottom of the production tubular or at least the packer must be above the perforations in the casing. The operator may allow for production logging, by setting the packer far enough away from perforations to be sure that he is above the perforations. In practice the packer may be set 100 or 1000 feet above the perforations thereby leaving the lowest gas injection point 100 or even 1000 feet above the perforations. Operators would prefer to produce all of the fluids from a well at least down to the perforations in the casing. A method of producing this remaining column of liquid calls for running a work line into the well to remove the gas lift valve in the side pocket mandrel. Then running back into the well with the bottom lift tool to stab the bottom lift tools stinger into the side pocket mandrel accessing the high pressure gas in the annular region. The high pressure gas is then routed into the stinger upwards into the body of the tool through flexible conduit or flexible joints then back down towards the bottom of the well or at least to the perforations through the bottom lift injector which may be of smaller diameter coil tubing such as three-quarter inch or 1 inch coil tubing.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A gas lift apparatus comprising:

a gas connection adapted to access a gas port in a side pocket mandrel in a well, a tubular having a first end, a second end, and at least two pivots, wherein the first end is connected to the gas connection, further wherein the tubular is able to direct a gas lower in the well, a bottom lift injector having an upper end and a lower end, wherein the upper end is connected to the tubular, further wherein gas flowing from the side pocket mandrel is directed into the gas connection then into the tubular then into the bottom lift injector and then out of the bottom lift injector.

2. The gas lift apparatus of claim 1 wherein, the gas connection is a gas lift valve.

3. The gas lift apparatus of claim 1 wherein, the gas connection is adapted to connect to a gas lift valve in the side pocket.

4. The gas lift apparatus of claim 1 wherein, the at least two pivots are a hose.

5. The gas lift apparatus of claim 1 wherein, the gas connection and the at least two pivots are a single piece.

6. The gas lift apparatus of claim 1 wherein, the lower end of the bottom lift injector extends below the side pocket mandrel.

7. The gas lift apparatus of claim 1 wherein, the lower end of the bottom lift injector extends below a packer below the side pocket mandrel.

8. The gas lift apparatus of claim 1 wherein, the lower end of the bottom lift injector extends below the lower end of the bottom lift injector extends below a hole allowing access to the formation zone.

9. The gas lift apparatus of claim 1 wherein, the lower end of the bottom lift injector is connected to a gas valve.

10. The gas lift apparatus of claim 1 wherein, the bottom lift injector has at least two nozzles.

11. A gas lift method comprising:

connecting a gas connection to a gas port in a side pocket mandrel in a well, flowing a gas from the side pocket mandrel through the gas connection into a tubular;

wherein the tubular has a multiplicity of pivots, wherein the pivotable tubular is able to direct the gas lower in the well, directing the gas into a bottom lift injector, directing the gas out of the bottom lift injector.

12. The gas lift method of claim 11 wherein, the gas connection is a gas lift valve.

13. The gas lift method of claim 11 wherein, the gas connection is adapted to connect to a gas lift valve in the side pocket.

14. The gas lift method of claim 11 wherein, the at least two pivots are a hose.

15. The gas lift method of claim 11 wherein, the gas connection and the are a single piece.

16. The gas lift method of claim 11 wherein, the lower end of the bottom lift injector extends below the side pocket mandrel.

17. The gas lift method of claim 11 wherein, the lower end of the bottom lift injector extends below a packer below the side pocket mandrel.

18. The gas lift method of claim 11 wherein, the lower end of the bottom lift injector extends below the lower end of the bottom lift injector extends below a hole allowing access to the formation zone.

19. The gas lift method of claim 11 wherein, the lower end of the bottom lift injector is connected to a gas valve.

20. The gas lift method of claim 19 wherein, the bottom lift injector has at least two nozzles.

* * * * *